United States Patent [19]

Denk et al.

[11] Patent Number: 4,554,777

[45] Date of Patent: Nov. 26, 1985

[54] CONVERTIBLE-FORMAT PACKAGING MACHINE

[75] Inventors: Josef Denk, Waiblingen; Walter Dietrich, Weinstadt; Otto Weller, Waiblingen, all of Fed. Rep. of Germany

[73] Assignee: Robert Bosch GmbH, Stuttgart, Fed. Rep. of Germany

[21] Appl. No.: 653,624

[22] Filed: Sep. 24, 1984

[30] Foreign Application Priority Data

Nov. 4, 1983 [DE] Fed. Rep. of Germany ..... 3339924

[51] Int. Cl.[4] ..... B65B 59/00

[52] U.S. Cl. ..... 53/201; 318/565; 493/34; 493/476; 493/478

[58] Field of Search ..... 53/201, 396; 493/34, 493/30, 478, 475, 476; 318/652, 562, 565, 567, 569

[56] References Cited

U.S. PATENT DOCUMENTS

| | | | |
|---|---|---|---|
| 3,323,285 | 6/1967 | Hagedorn | 53/374 |
| 3,325,977 | 6/1967 | Kirsten | 53/250 |
| 3,373,665 | 3/1968 | Bivans | 493/181 |
| 3,509,681 | 5/1970 | Sass | 53/473 |
| 3,514,922 | 6/1970 | Cravens et al. | 53/201 X |
| 3,940,675 | 2/1976 | Schroeder | 318/601 X |
| 4,216,415 | 8/1980 | Shimonou et al. | 318/601 X |
| 4,264,848 | 4/1981 | Jansen | 318/565 |
| 4,323,098 | 4/1982 | Suzuki et al. | 493/34 X |
| 4,371,365 | 2/1983 | Shingo | 493/34 X |
| 4,485,338 | 11/1984 | Matsuura et al. | 318/569 |

*Primary Examiner*—James F. Coan

*Attorney, Agent, or Firm*—Edwin E. Greigg

[57] ABSTRACT

For adjustment to various formats in accordance with the products to be packaged and the packages used, structural parts, tools and devices of a packaging machine are equipped to be adjustable. In order to be able to effect adjustment as intended and quickly by means of displaceable parts equipped with set screws at the changeover locations, the packaging machine has a mobile drive unit, which can be coupled with the set screws of the various changeover locations. The drive unit is controlled by a control unit which is programmable in accordance with the format, and is used by the operator at a given changeover location as indicated by the control unit.

7 Claims, 4 Drawing Figures

CONVERTIBLE-FORMAT PACKAGING MACHINE

BACKGROUND OF THE INVENTION

The invention is based on a packaging machine as generally defined hereinafter. For adapting the machine to the shape and size of the various products to be packed and to the packages used for this purpose, such as boxes, pouches, wrappers, cans, bottles, dishes and the like—known in the field as format changing—the individual processing and handling devices, such as delivery, conveyor, folding, shaping and closing devices, are designed to be adjustable. To this end, as shown for example in U.S. Pat. No. 3,509,681, the adjustable parts have slits through which adjustable clamping screws are passed, or such parts are secured on sliding guides, which can be displaced in a finely adjustable manner using set screws. In each case, the changeover of the known machines to a different format is quite time-consuming. In complicated machines, such as cartoning machines, up to a hundred individual parts and tools, or even more, must be readjusted each time. Furthermore, a format change requires extensive skill and experience on the part of the worker, because the individual structural parts and tools must be adjusted using patterns for the products and packages. Often, an adjustment also depends on the position of some previously adjusted part, so that if one part or tool is incorrectly adjusted, this part and others dependent on it must later be adjusted again. Finally, after the changeover of the machine has been completed, further readjustments must still be made repeatedly because of tolerances and fluctuations in the products and packages, in order to assure problem-free operation. Such later readjustments often take several times as long to accomplish as did the preceding changeover.

Cartoning machines are also known in which individual tools and structural parts are equipped with a motor-driven adjusting device. The adjusting devices provided with a position transducer can be triggered by a central control device, in which format-dependent data are stored. Such adjusting devices are advantageous with structural parts that are difficult to see or gain access to. The engineering expense of so equipping all the tools and parts that are adjustable in accordance with format is extremely high. Also, many locations in the machine have no space for drive motors.

OBJECT AND SUMMARY OF THE INVENTION

It is accordingly the primary object of the invention to design a packaging machine in such a manner that a format change can be accomplished in a short time as possible without requiring further readjustments.

The packaging machine according to the invention has the advantage that a change in format can be made in an intended manner and very quickly, later readjustments being unnecessary. Furthermore a format change can be performed by an operator who does not have extensive skill and experience with the machine but can instead be trained.

Advantageous further embodiments of and improvements to the packaging machine disclosed hereinafter are also possible. In particular, the indication or display of the changeover location to be actuated at a given time is advantageous, so that the operator can work on the individual changeover locations in the proper sequence.

In a method for a format change in a packaging machine as disclosed herein the specified set-point positions of the structural parts can be attained quickly and precisely under the control of the control unit.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
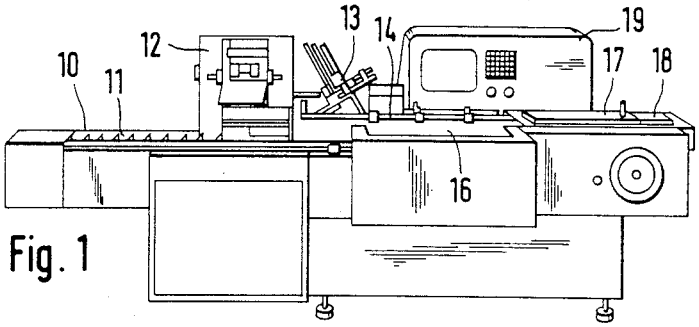
FIG. 1, in simplified form, shows a cartoning machine in a perspective view.

A cartoning machine 10, which is shown as an example of a packaging machine, has a product delivery device 11, a brochure folding apparatus 12, a folding box magazine 13, a folding box conveyor device 14 with drive fingers 15, a folding and closing device 17, an outlet 18 and a control unit 19. The devices 11–18 of the cartoning machine 10 have tools and structural parts that are adjustable within a certain range, so that the machine can be adjusted or converted for packaging objects with differing dimensions in folding boxes 1 of appropriate length, width and height.

Figure 2:
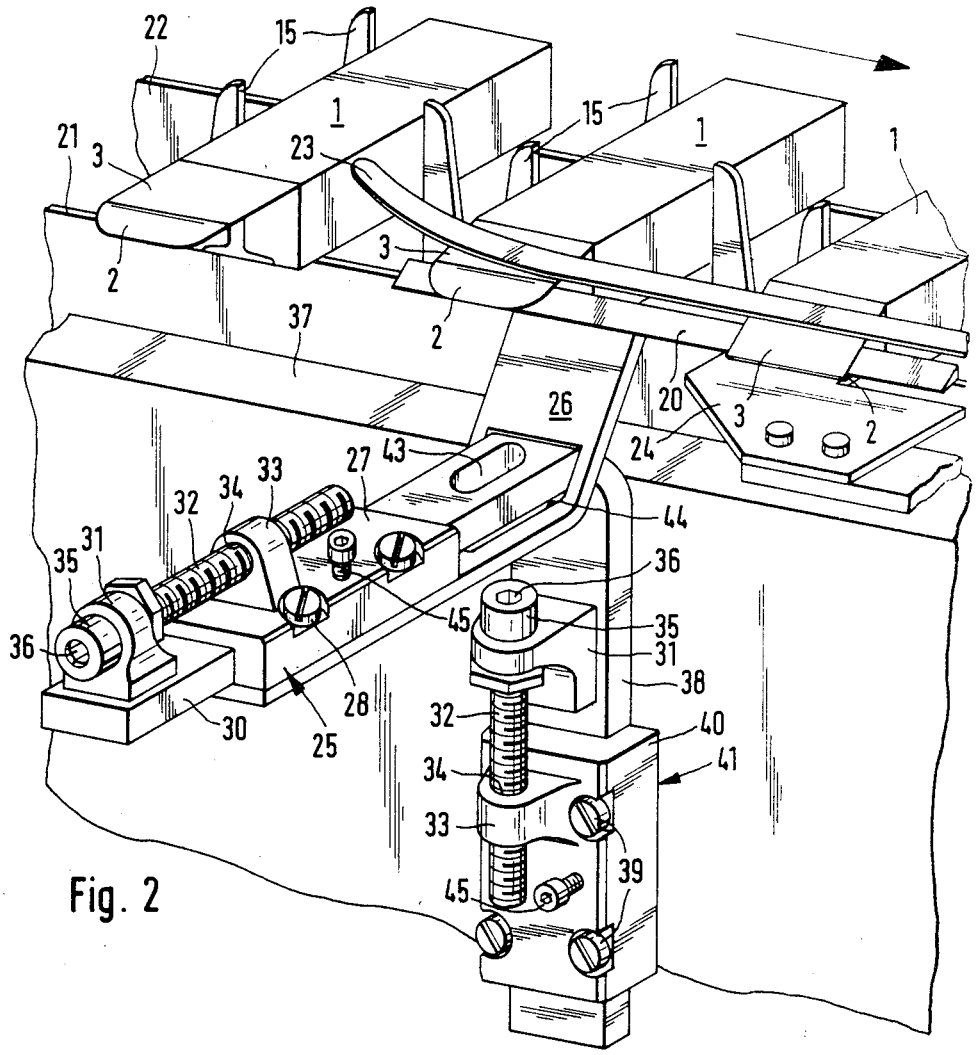
FIG. 2 shows a folding device of the packaging machine according to FIG. 1, having an adjusting device, seen in a perspective view.
Figure 3:
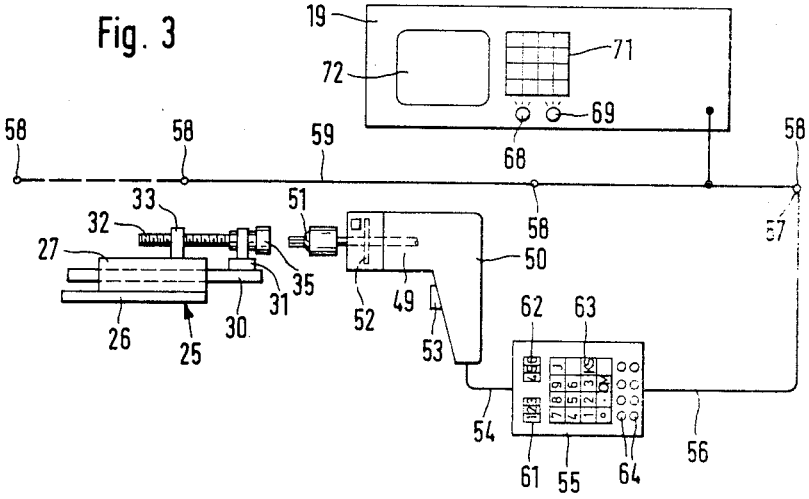
FIG. 3, in simplified form, shows a mobile drive mechanism for adjusting devices.
Figure 4:
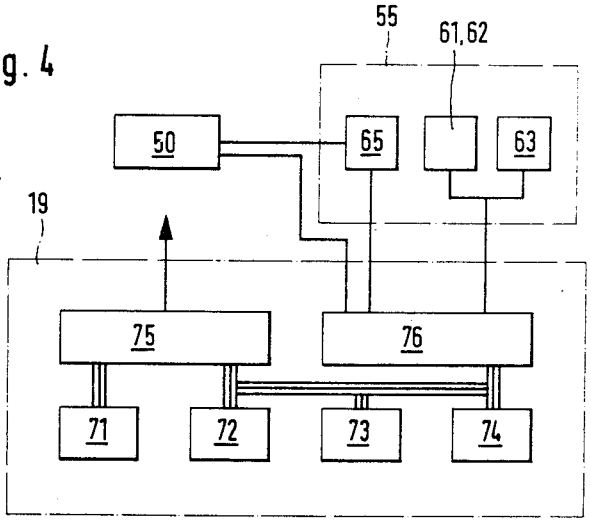
FIG. 4 is a block circuit diagram of a control means for the mobile drive mechanism.

Only one folding rail 20 of the folding and closing device 17 for folding over an insertion tab 2 on an end flap 3 of the folding boxes 1 is shown (FIG. 2) and explained herein to serve as an example of how the devices 11–18 can be changed over. In accordance with the length and height of the folding boxes 1 to be processed, the folding rail 20 should be positioned in a predetermined position relative to support rails 21, 22 of the conveyor device 14, a folding guide member 23 and an incrementally moved folding slide 24.

The folding rail 20 is supported by a bent arm 26, which is secured on a carriage 27 of a sliding guide 25 with screws 28. The carriage 27 is displaceable on a guide rail 30, which extends in the horizontal plane transverse to the direction of conveyance of the folding box conveyor device 14 and to the longitudinal extension of the folding rail 20. For displacing the carriage 27 on the guide rail 30, a set screw 32 is supported radially but not axially displaceably in a bearing block 31 on the guide rail 30, with its threaded part engaging a threaded bore 34 of an eye 33 on the carriage 27. The set screw 32 has a head 35 with a hexagonal recess 36, with which a hexagonal tang of a tool can be positively coupled. By rotating the set screw 32 in one direction or the other, the carriage 27, along with the arm 26 and the folding rail 20, is displaced horizontally. One end position of the carriage 27, in which the carriage 27 rests on the rail 30, is called a reference zero position, which will be explained in greater detail later herein.

Since the folding rail 20 also has to be adjustable in height, the guide rail 30 is not rigidly secured to the machine frame 37 but instead is vertically displaceable with a rectangularly bent arm 38 in a carriage 40 secured in a stationary manner to the machine frame 37 with screws. The second sliding guide 41 comprising the arm 38 and the carriage 40, like the sliding guide 25, has a set screw 32 with a head 35 and an eye 33 with a threaded bore 34, as well as a bearing block 31. In order that the head 35 of the set screw 32 of the second sliding guide 41, which is disposed below the guide rail 30, is accessible from above in order engage it with a tool, the guide rail 30 has an oblong slot 43 in a prolongation with respect to the set screw 32. The arm 26 also has a opening 44 through which the guide rail 30 passes. In order to fix the sliding guides 25 and 41 in specific positions, releasable locking screws 45 and 45' are screwed into the carriages 27 and 40 respectively thereby pressing against each of the guide rails 30 and 38, as clearly shown in FIG. 2.

The other devices 11–18 and their structural parts which are adjustable to various formats of the products to be packaged and folding boxes to be used are likewise equipped with the same above-described sliding guides 25, 41; in the case of adjustment in one dimension, a single sliding guide is provided, while for two-dimensional adjustment two sliding guides coupled together at an angle are provided.

For adjusting the sliding guides, a mobile, hand-guided rotary drive unit 50 is used, having a coupling piece 51 which can be positively coupled with the hexagonal recess 36 of the head 35 of the set screws 32. The coupling piece 51 may also be disposed on an extension which can be connected to the drive unit 50. The drive unit 50 includes an electric motor 49, the rotational direction of which can be reversed, and a position transducer 52. The position transducer 52, which generates electrical signals in accordance with the varying position of a sliding guide, is preferably of the type which generates a predetermined number of electrical pulses per revolution. In order to switch on the electric motor 49, the drive unit 40 has a finger-actuated pushbutton contact 53. For supplying electrical energy and to pass on the electrical signals of the position transducer 52, the drive unit 50 is connected by means of a multi-conductor cable 54 with a switching unit 55. This switching unit 55 in turn can be connected by means of a cable 56 and a plug 57 with one of several terminals 58 of a distributor or perimeter line 59, which leads to the central control unit 19.

The switching unit 55 has a luminous display 61 for the identification number of the particular changeover location to be approached, a luminous display 62 for the position, an entry keyboard 63 with preselect keys for entering, cancelling and correcting numbers of the changeover locations and positions, and several monitor lights 64. An amplifier 65 is also provided in the switching unit 55. The switching unit 55, which may also be secured to the mobile drive unit 50, is like the mobile drive unit and is not stationary, so that the operator can take it with him, together with the mobile drive unit 50, to the particular changeover location of the machine to be approached at a particular time, and there initiate and monitor a changeover.

Like the switching unit 55, the control unit 19 also has an entry keyboard 71, with the same functions as those of the entry keyboard 63. In addition, the control unit 19 has two operating mode switches 68, 69. Furthermore, a monitor 72 is disposed on the control unit 19 in a visible manner, and on it data and instructions for the operator can be displayed in a program-controlled manner. The control unit 19 further includes a memory 73 for storing the data of the various number-identified changeover locations of the machine for several formats and also for storing programs for the course of the changeovers. The stored and entered data and signals are processed by a microprocessor 74 and the signals are passed on. To this end, the keyboard 71, the monitor 72, the memory 73, the microprocessor 74, the switching unit 55 and the mobile drive unit 50 are interconnected via two interfaces 75, 76. Via the interface 75, signals relating to various positions occupied by movable structural parts and tools of the machine can also be entered into the control means.

A particular format is established in the following manner:

With the machine stopped, the operator first places the switch 68 to "adjustment" and the switch 69 to "format data callup", and then via the keyboard 71 on the control unit 19 or the keyboard 63 on the switching unit 55 enters the identification number associated with the format to be established into the control unit. The format identification number entered is indicated on the monitor 72. The number of the first changeover location to be approached and its designation are then shown on the monitor as well. The number of the changeover location to be approached is indicated in the same manner in the luminous display 61 of the switching unit 55. The operator now goes with the mobile drive unit 50 and the switching unit 55 to the indicated changeover location and couples the coupling piece 51 to the head 35 of the set screw 32 of that changeover location. By pressing the pushbutton contact 53, the operator signals the readiness for changeover to the control unit 19. Under the control of the program entered, the control unit 19 thereupon first switches the mobile drive unit to counterclockwise rotation, so that the associated sliding guide 25 is first moved into its reference zero position. After reaching the zero position, the rotational direction of the drive unit 50 is reversed by the computer, because of the abruptly increasing current, thus moving the sliding guide 25 toward the new position. In so doing, the pulses generated by the position transducer 52 of the drive unit 50 are passed on to the control unit 19, in which an actual-value/set-point-value comparison is performed. When the signals are evaluated, the drive unit 50 is shifted over, shortly before reaching its end position, from high speed to crawling speed, and on reaching the predetermined position of the motor 49, the drive unit 50 is shut off. The adjustment distance travelled since leaving the reference position is indicated in millimeters in the luminous display 62 of the switching unit 55 and can be compared with the set-point value also displayed on the monitor 72. If the two values agree, the operator registers the completion of the changeover at the predetermined changeover location by pressing the acknowledgement key of the keyboard 63 of the switching unit 55. The number and designation of the next changeover location to be approached, and the adjustment distance, thereupon appear on the monitor 72. The number of the next changeover location is likewise indicated in the luminous disply 61 of the switching unit 55. The operator goes with the mobile drive unit 50 to the indicated changeover location and proceeds as described above. The pre-programmed courses of operation are continued in the same manner, until all the changeover locations have been converted to the new format.

The individual programs and data are stored in the memory 73. If the data exceed the capacity of the memory 73, then other programs can also be introduced into the control unit 19 on diskettes and similar data carriers. The data for the individual programs can be entered into the memory via the keyboard 71 of the control unit, based on the known displacement distances. However, they can also be ascertained empirically and then entered, by initially adjusting the changeover locations to the format by hand and then returning the sliding guide 25 of each changeover location to the reference zero position with the mobile drive unit 50. The signals generated by the position transducer 52 of the drive unit 50 in this process are passed on to the microprocessor 74, evaluated by it, and stored in the memory 73.

It should also be noted that at changeover locations which are not accessible, stationary drive units are preferably used, which have not only a drive motor but a position transducer as well. Adjustment of these changeover locations is effected during the course of the selected program or by an entry on the part of the operator via the keyboard 71 of the control unit 19.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A packaging machine having devices for conveying, shaping and handling the packages, and for delivering the products to be packaged in which structural parts which are displaceable with set screws and adjustable to various formats of products and packages are provided at a plurality of changeover locations, characterized in that said set screws each have an identical coupling part arranged to receive a mobile drive mechanism, said mobile drive mechanism further including a coupling counterpart which can be coupled with said set screws, and further that said mobile drive mechanism can be connected with a control unit, in which adjustment values of various package formats are stored for the various structural parts.

2. A packaging machine as defined by claim 1, characterized in that said mobile drive mechanism comprises a position transducer, which furnishes the adjustment distance of a structural part, in the form of electrical signals, to said control unit, in which a set-point/actual-value comparison is performed and which stops the mobile drive mechanism when the set-point and actual values are identical.

3. A packaging machine as defined by claim 2, characterized in that said position transducer is equipped for furnishing travel-dependent digital signals.

4. A packaging machine as defined by claim 1, characterized in that said control unit further includes a memory for storing the adjustment values of the structural parts for a plurality of formats evaluated by a computer, said control unit also commanding when a predetermined changeover location is selected to thereby furnish the set-point adjustment value and, after the mobile drive mechanism is actuated and the set-point position of the structural part is attained, turns the mobile drive mechanism off.

5. A packaging machine as defined by claim 2, characterized in that said control unit further includes a memory for storing the adjustment values of the structural parts for a plurality of formats evaluated by a computer, said control unit also commanding when a predetermined changeover location is selected to thereby furnish the set-point adjustment value and, after the mobile drive mechanism is actuated and the set-point position of the structural part is attained, turns the mobile drive mechanism off.

6. A packaging machine as defined by claim 3, characterized in that said control unit further includes a memory for storing the adjustment values of the structural parts for a plurality of formats evaluated by a computer, said control unit also commanding when a predetermined changeover location is selected to thereby furnish the set-point adjustment value and, after the mobile drive mechanism is actuated and the set-point position of the structural part is attained, turns the mobile drive mechnism off.

7. A method for adjusting a packaging machine to enable the same to produce various types of package formats from stored programs comprising the steps of, (a) storing programs in a computer memory of a control unit;

(b) entering the identification number of a particular format to be produced into said control unit;

(c) displaying a package identification number on a monitor display of said control unit to verify accuracy in the computer memory;

(d) identifying on said monitor display the desire changeover location;

(e) accessing information into the packaging machine at the changeover location indicated by the control unit by means of a mobile drive unit having a luminous display and switching unit whereupon the control unit erases from memory an earlier package creating position and moves a sliding guide in one direction into a reference zero position;

(f) reversing travel direction of said sliding guide by means of said computer and storing this movement in said control unit;

(g) displaying on said luminous display of said mobile unit the adjustment distance travelled from said reference position for comparison with said monitor display;

(h) registering the completion of said changeover location when the desired values are attained, and (i) acknowledging the completion of the changeover location by operation of a key on said switching unit.

* * * * *